United States Patent [19]

Disharoon

[11] 4,011,687

[45] Mar. 15, 1977

[54] AIR CONDITIONER WINDOW SASH

[76] Inventor: Gary Siegle Disharoon, 1301 Earle Ave., Chesapeake, Va. 23324

[22] Filed: Nov. 25, 1975

[21] Appl. No.: 635,384

[52] U.S. Cl. ..... 49/70; 49/168; 49/404; 98/94 AC; 62/262

[51] Int. Cl.[2] ..... E06B 7/03

[58] Field of Search ..... 49/404, 408, 407, 168, 49/171, 169, 70; 98/94 AC; 62/262; 21/87; 312/101; 232/22, 42

[56] References Cited

UNITED STATES PATENTS

| | | | |
|---|---|---|---|
| 1,213,593 | 1/1917 | Dahlberg | 312/101 |
| 2,846,734 | 8/1958 | Zitomer | 49/407 X |
| 3,177,924 | 4/1965 | McPhail | 49/168 X |
| 3,680,258 | 8/1972 | Loyd | 49/168 |

*Primary Examiner*—Kenneth Downey

[57] ABSTRACT

A window sash intended for use in conjunction with windows of homes or buildings. The invention comprises a short sash constructed of varying designs, materials and dimensions in order that it may work in conjunction with all window units in the building trade. It is to be inserted into the existing tracks of the window unit for which it is intended. The said invented sash is intended to replace the existing lower window sash of any window that may be chosen as the recipient for a receptacle such as an air conditioner window unit or window fan and the like.

1 Claim, 7 Drawing Figures

FIG 1
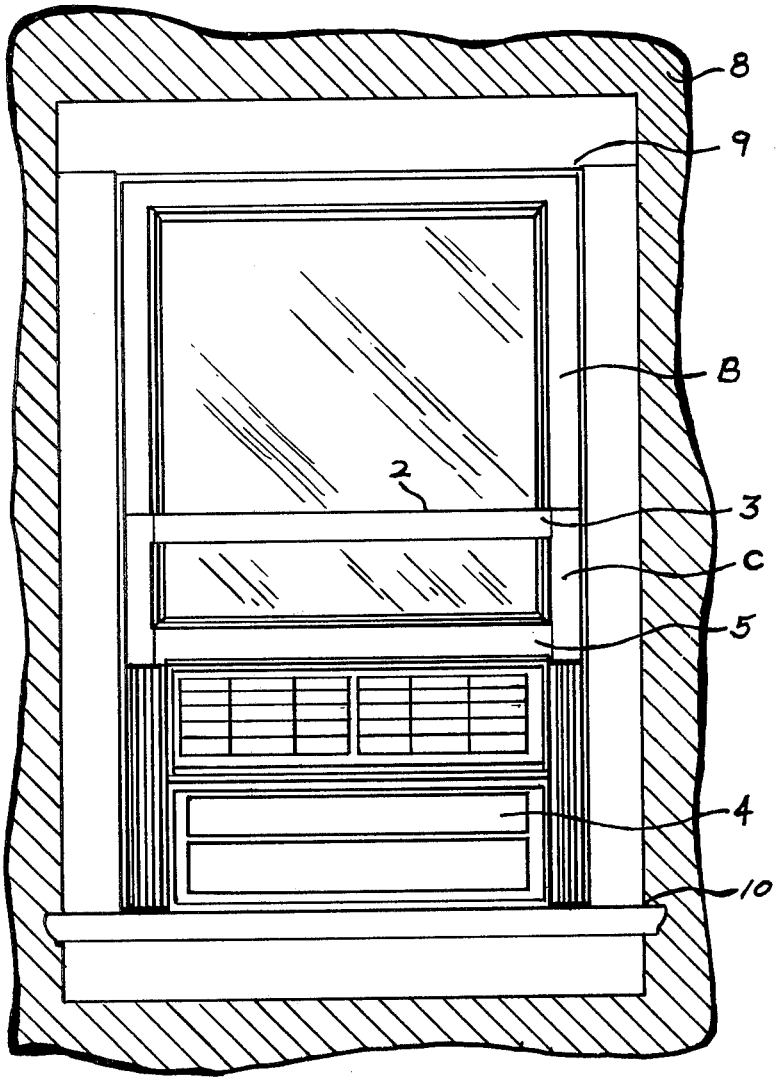
FIG 2
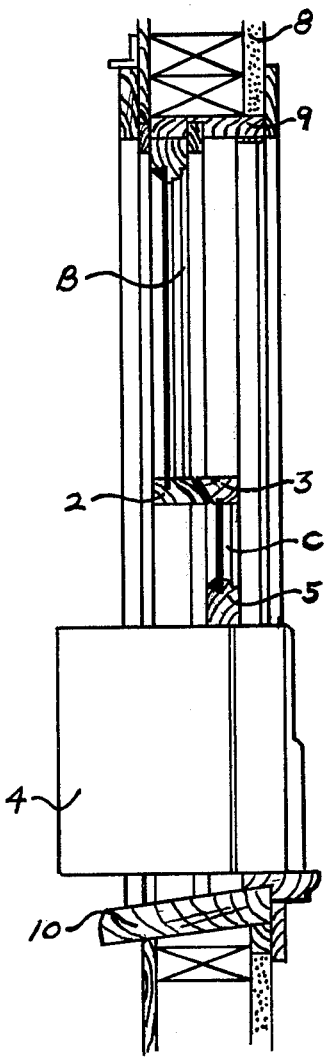
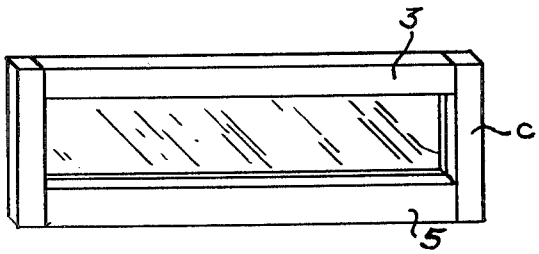
FIG 3

AIR CONDITIONER WINDOW SASH

The present invention relates to the mounting of window unit air conditioners and related objects such as window fans and the like. It is intended for use wherever an air conditioner is placed into a window or opening and a more efficient installation is desired.

BACKGROUND OF THE INVENTION

A person installing a window unit air conditioner or related object into a window must use the existing sashes in order to complete the installation. This is accomplished by raising the bottom sash and inserting the air conditioner and then lowering the bottom sash onto the top of the air conditioner, thereby creating an overlap of the top and bottom sashes. This is the area of most concern for the void space between the two sashes collects dirt and cannot be cleaned. This is a condition that must be contended with by every housewife in the country who is concerned with the cleanliness of her home and is one of the major drawbacks when one considers purchasing a window unit air conditioner. In an effort to eliminate this problem the AIR CONDITIONER WINDOW SASH was invented.

The present invention is founded on the basic concept of providing a window sash that will both rest on the top of the air conditioner unit or related object and align with the top window sash meeting rail, thereby, eliminating the overlaping of the two window sashes.

To provide the desired installation the invention must be constructed from the same material and of the same designs to correspond to the window sash or opening for which the said invented window sash may be needed. Thus, by way of example, the window may be of wood construction and of a colonial design or it may be of steel construction with a single light or plain design, etc. It should also be noted that the said invention will be constructed in various dimensions to correspond to the various window sizes and openings used throughout the building trade.

OBJECTS OF THE INVENTION

With the foregoing conditions in mind, the present invention has in view the following objectives;

1. To provide a window sash comprising a bottom rail, top meeting rail and a glass or composition insert.
2. To provide a window sash of the kind described in varing designs such as colonial, plain, etc.
3. To provide a window sash of the type noted in all the different dimensions used in the building trade.
4. To provide a window sash of the character aforesaid, to correspond to window designs and dimensions of the past, present and future.

SUMMARY OF THE INVENTION

The foregoing objects are achieved by providing a window sash to be used between the top of the window unit air conditioner, receptacle or the like, and the bottom meeting rail of the existing top window sash or the top of the opening.

The invented window sash comprises a bottom rail, a top meeting rail, a glass or composition insert which ever the case may be.

For a full and more complete understanding of the invention, reference may be had to the following description and the accompanying drawings wherein:

FIG. 1 is an elevational view taken from the inside at a portion of a home having a window unit with the air conditioner unit inserted into the window and the invented window sash in place, showing the alignment of the two meeting rails;

FIG. 2 is a side elevational view, partially in section of the window unit as depicted in FIG. 1;

FIG. 3 is a perspective view of the invented window sash itself showing the bottom rail and top meeting rail and is depicted as being of a plain design with glass inserts;

Figure 6:
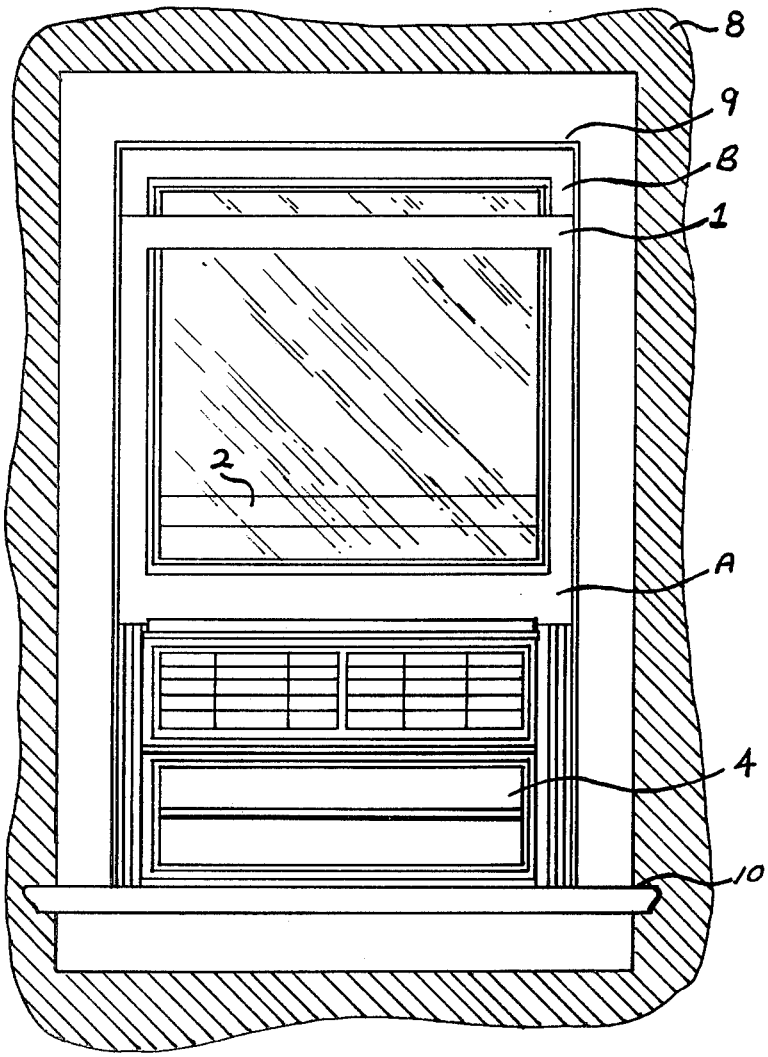
Figure 7:
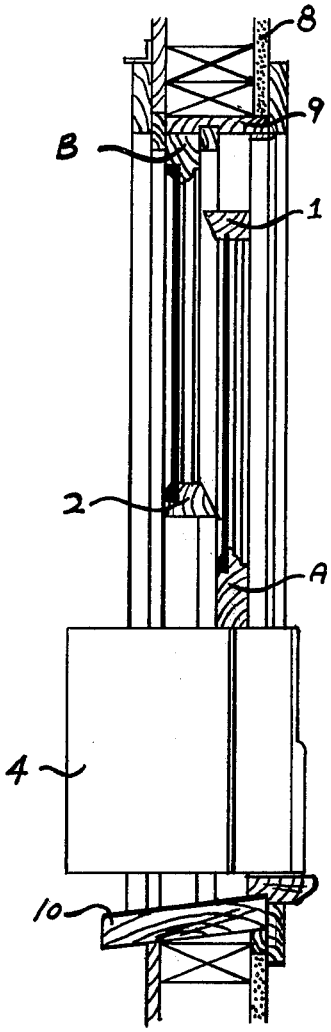

FIG. 6 is an elevational view taken from the inside at a portion of a home having a window unit with an air conditioner unit inserted into the window using the existing lower inside sash to complete the installation. This is the standard procedure to date for installing window unit air conditioners and the like. This drawing is for reference and comparison also;

FIG. 7 is a side elevational view, partially in section of the window unit as depicted in FIG. 6.

Before entering into a detailed description of the embodiments illustrated in the drawings, it is noted that the said invention is described and illustrated as being associated with a particular type and design window in conjunction with a window unit air conditioner. However, it is to be clearly understood that the invented window sash is also susceptible of being operatively associated with all types, sizes and designs of windows and openings either past, present or future; and to correspond to any object that may be inserted into a window or opening. It should also be noted that the invented window sash will be constructed from all materials used throughout the building trade. The same principles that are used in the said window sash can also be applied to windows commonly known as the storm window.

DESCRIPTION OF THE PREFERRED EMBODIMENTS

Figure 4:
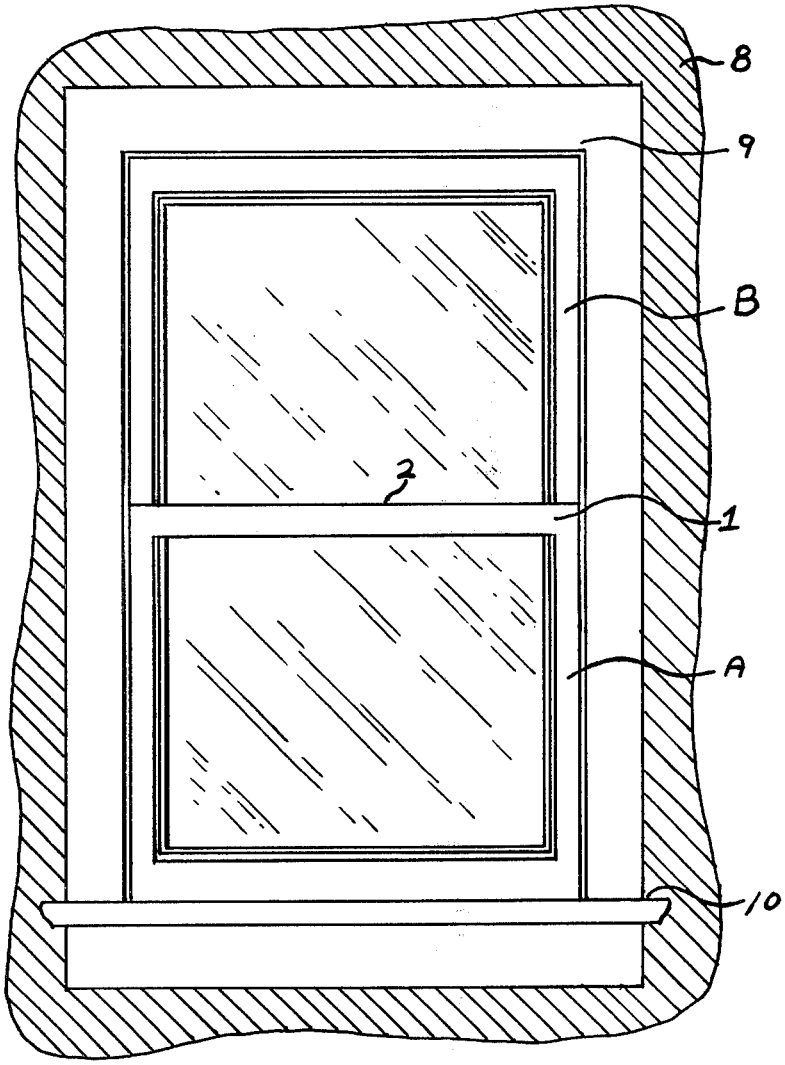
FIG. 4 is an elevational view taken from the inside at a portion of a home having a window. This view is of a standard window sash used throughout the building industry and is provided for the purpose of a reference only.
Figure 5:
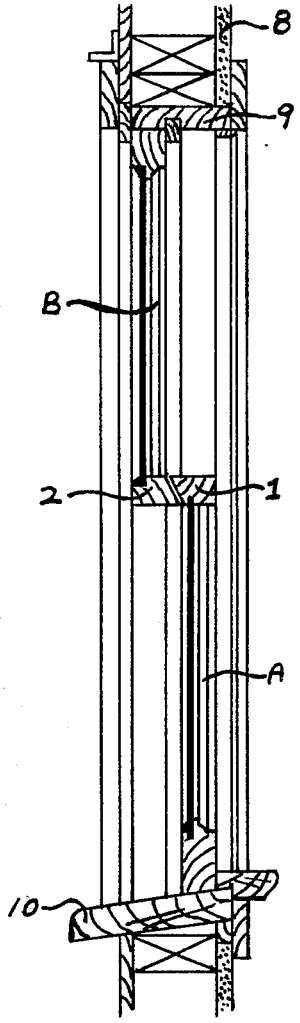
FIG. 5 is a side elevational view, partially in section of the window unit as depicted in FIG. 4.

Referring now to the drawings wherein like reference characters denote corresponding elements throughout the several views. In order to coordinate the several views and to give a more clear understanding of the invented window sash I would like to begin with FIGS. 4 and 5 wherein a portion of an inside wall of a home is designated 8. Wall 8 is formed with a standard window unit consisting of a headjamb 9, a sill 10, a top sash B, and a bottom sash A, with the two meeting rails 1 and 2 in alignment as the two sashes are fully extended, this being a standard window unit with no object inserted. FIGS. 6 and 7 show the same window unit as FIG. 4 and FIG. 5 except with an air conditioner 4 installed illustrating that with the inside and bottom sash A resting on the top of the air conditioner 4 the misalignment of the two meeting rails 1 and 2 of sashes A and B thereby creates the void space between the two window sashes A and B. This misalignment is eliminated as depicted in FIGS. 1 and 2 by removing the inside bottom window sash A and replacing it with the invented window sash C shown in FIG. 3 noting that the invented window sash C consists of a bottom rail 5 and a top meeting rail 3. The invented sash C is inserted into the same tracks from which the preceding window sash A is removed. When the invented window sash C is installed the bottom rail 5 will rest on the air conditioner unit 4 and the top meeting rail 3 will align with the bottom meeting rail 2 of the outside and top window sash B.

While preferred specific embodiments are herein disclosed, it is to be clearly understood that the invention is not to be limited to the exact construction, materials and devices illustrated and described because of various modifications of these details that may be provided in putting the invention into practice.

What is claimed is:

1. A double hung window assembly adapted to receive a receptacle enclosing an air conditioner unit or the like comprising:

a vertically movable upper window sash adapted to close substantially the upper half of the opening defined by said window assembly when situated at an uppermost position thereof, said upper window sash including a bottom rail positioned at substantially the vertical midpoint of said opening defined by said window assembly when situated at said uppermost position thereof; and a vertically movable lower window sash adapted to close a portion of substantially the lower half of said opening defined by said window assembly, said lower window sash including a top rail operationally positionable at the level of and operationally abutting said bottom rail of said upper window sash when said upper window sash is situated at said uppermost position thereof, said lower window sash further including a bottom rail operationally positioned a predetermined distance above the lower edge of said opening defined by said window assembly when said top rail thereof is operationally at the level of and abutting said bottom rail of said upper window sash when said upper window sash is at said uppermost position thereof, said bottom rail of said operationally positioned lower window sash being adapted to abut the upper surface of a receptacle enclosing an air conditioner unit or the like mountable in said opening defined by said window assembly with the lower surface thereof resting upon said lower edge of said opening defined by said window assembly.

* * * * *